US008497829B2

(12) United States Patent
Hosaka et al.

(10) Patent No.: US 8,497,829 B2
(45) Date of Patent: Jul. 30, 2013

(54) VIDEO PROCESSING CIRCUIT, LIQUID CRYSTAL DISPLAY DEVICE, ELECTRONIC APPARATUS, AND VIDEO PROCESSING METHOD

(75) Inventors: Hiroyuki Hosaka, Matsumoto (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 164 days.

(21) Appl. No.: 13/022,138

(22) Filed: Feb. 7, 2011

(65) Prior Publication Data

US 2011/0205207 A1 Aug. 25, 2011

(30) Foreign Application Priority Data

Feb. 25, 2010 (JP) ..... 2010-039794

(51) Int. Cl.
*G09G 3/36* (2006.01)

(52) U.S. Cl.
USPC ..... 345/89; 345/690

(58) Field of Classification Search
USPC .... 345/84–100, 204–215, 690–699; 349/123, 349/125, 130, 134
See application file for complete search history.

(56) References Cited

U.S. PATENT DOCUMENTS

| | | | | |
|---|---|---|---|---|
| 6,222,515 | B1 * | 4/2001 | Yamaguchi et al. | 345/89 |
| 7,932,915 | B2 * | 4/2011 | Miyata et al. | 345/690 |
| 7,956,834 | B2 * | 6/2011 | Kang | 345/89 |
| 8,072,407 | B2 * | 12/2011 | Tanaka et al. | 345/94 |
| 8,184,076 | B2 * | 5/2012 | Katayama et al. | 345/87 |
| 8,212,755 | B2 * | 7/2012 | Tanaka et al. | 345/89 |
| 8,242,991 | B2 * | 8/2012 | Kato et al. | 345/87 |
| 2003/0058264 | A1 * | 3/2003 | Takako et al. | 345/698 |
| 2005/0030302 | A1 * | 2/2005 | Nishi et al. | 345/204 |
| 2006/0072664 | A1 * | 4/2006 | Kwon et al. | 375/240.16 |
| 2007/0063947 | A1 * | 3/2007 | Kang | 345/89 |
| 2008/0018630 | A1 * | 1/2008 | Fujino | 345/205 |
| 2008/0100633 | A1 * | 5/2008 | Dallas et al. | 345/530 |
| 2008/0246784 | A1 * | 10/2008 | Mori | 345/690 |
| 2010/0098349 | A1 | 4/2010 | Arashima et al. | |
| 2010/0156772 | A1 | 6/2010 | Arashima et al. | |
| 2010/0207934 | A1 * | 8/2010 | Kato et al. | 345/214 |
| 2011/0176071 | A1 | 7/2011 | Iisaka et al. | |

FOREIGN PATENT DOCUMENTS

| | | |
|---|---|---|
| CN | 102129849 A | 7/2011 |
| JP | A-6-34965 | 2/1994 |
| JP | A-2009-69608 | 4/2009 |
| JP | A-2009-169411 | 7/2009 |
| JP | A-2009-169412 | 7/2009 |

* cited by examiner

*Primary Examiner* — Amare Mengistu
*Assistant Examiner* — Dmitriy Bolotin
(74) *Attorney, Agent, or Firm* — Oliff & Berridge, PLC

(57) ABSTRACT

A video processing circuit, includes: a boundary detection section adapted to detect a boundary between a first pixel having an applied voltage, which is designated by the video signal input and is lower than a first voltage, and a second pixel having an applied voltage, which is designated by the video signal input and is one of equal to and higher than a second voltage higher than the first voltage, in a present frame and in a previous frame, which is one frame earlier than the present frame, respectively; and a correction section adapted to correct the video signal adapted to designate the applied voltages to the liquid crystal elements corresponding to the first pixel and the second pixel abutting on a moving section in the boundary of the present frame moving one pixel from the boundary in the previous frame so as to reduce a lateral electrical field caused by the first pixel and the second pixel.

5 Claims, 12 Drawing Sheets

SCAN LINE DRIVE CIRCUIT

VIDEO PROCESSING CIRCUIT

WITHOUT CORRECTION PROCESS

WITH CORRECTION PROCESS

PREVIOUS FRAME

PRESENT FRAME

PRESENT FRAME

< NORMALLY BLACK MODE >

WITHOUT CORRECTION PROCESS

WITH CORRECTION PROCESS

PREVIOUS FRAME

< (ORIGINAL) VIDEO SIGNAL >

| | | | | | | |
|---|---|---|---|---|---|---|
| a | a | b | b | b | b | b |
| a | a | a | b | b | b | b |
| a | a | a | a | b | b | b |
| b | a | a | a | a | b | b |
| b | b | a | a | a | b | b |
| b | b | b | a | a | b | b |

< DETECTED BOUNDARY >

PRESENT FRAME

< (ORIGINAL) VIDEO SIGNAL >

| | | | | | | |
|---|---|---|---|---|---|---|
| a | a | a | a | a | b | b |
| a | a | a | a | a | b | b |
| a | a | a | a | a | b | b |
| b | b | b | b | a | b | b |
| b | b | b | b | a | b | b |
| b | b | b | b | a | b | b |

< DETECTED BOUNDARY >

PRESENT FRAME

< CORRECTED VIDEO SIGNAL >

| | | | | | | |
|---|---|---|---|---|---|---|
| a | a | a | a | a | b | b |
| a | c2 | a | a | a | b | b |
| a | c2 | a | c2 | c2 | c2 | b |
| b | c2 | b | b | a | b | b |
| b | b | b | b | a | b | b |
| b | b | b | c2 | c2 | b | b |

< APPLICATION BOUNDARY >

PREVIOUS FRAME

PRESENT FRAME

PRESENT FRAME

PREVIOUS FRAME

< (ORIGINAL) VIDEO SIGNAL >

| | | | | | | |
|---|---|---|---|---|---|---|
| a | a | b | b | b | b | b |
| a | a | a | b | b | b | b |
| a | a | a | a | b | b | b |
| b | a | a | a | a | b | b |
| b | b | a | a | a | b | b |
| b | b | b | a | a | b | b |

< DETECTED BOUNDARY >

PRESENT FRAME

< (ORIGINAL) VIDEO SIGNAL >

| | | | | | | |
|---|---|---|---|---|---|---|
| a | a | a | a | a | b | b |
| a | a | a | a | a | b | b |
| a | a | a | a | a | b | b |
| b | b | b | b | a | b | b |
| b | b | b | b | a | b | b |
| b | b | b | b | a | b | b |

< DETECTED BOUNDARY >

PRESENT FRAME

< CORRECTED VIDEO SIGNAL >

| | | | | | | |
|---|---|---|---|---|---|---|
| a | a | a | a | a | b | b |
| a | a | a | a | a | b | b |
| a | ▒ | a | a | a | b | b |
| b | ▒ | b | b | a | b | b |
| b | b | b | b | a | b | b |
| b | b | b | ▒ | ▒ | b | b |

< APPLICATION BOUNDARY >

VIDEO PROCESSING CIRCUIT, LIQUID CRYSTAL DISPLAY DEVICE, ELECTRONIC APPARATUS, AND VIDEO PROCESSING METHOD

BACKGROUND

1. Technical Field

The present invention relates to a technology for reducing failure on display in a liquid crystal panel.

2. Related Art

Liquid crystal panels have a configuration in which one of a pair of substrates has pixel electrodes corresponding to respective pixels arranged in a matrix, the other substrate has a common electrode disposed so as to be common to all of the pixels, and a liquid crystal is sandwiched between each of the pixel electrodes and the common electrode. In such a configuration, when a voltage corresponding to a grayscale level is applied and held between each of the pixel electrodes and the common electrode, the orientational state of the liquid crystal is defined every pixel, and thus, the transmittance or the reflectance is controlled. Therefore, it can be said that in the configuration described above, only the component out of the electrical field acting on the liquid crystal molecules having a direction (or the opposite direction) from the pixel electrode to the common electrode, namely the direction perpendicular (vertical) to the surface of the substrate makes a contribution to the display control.

Incidentally, as the pixel pitch of the liquid crystal panel is narrowed due to miniaturization and improvement in definition, an electric field generated between the pixel electrodes adjacent to each other, namely the electrical field in a direction (lateral direction) parallel to the surface of the substrate, is generated, and further the influence thereof is becoming nonnegligible. When a lateral electrical field is applied to the liquid crystal to be driven by an electrical field in a vertical direction such as a vertical alignment (VA) liquid crystal or a Twisted Nematic (TN) liquid crystal, there arises a problem that orientation failure (reverse tilt domain) of the liquid crystal is caused to thereby cause failure on display.

In order for reducing the influence of the reverse tilt domain, there are proposed a technology (see, e.g., JP-A-6-34965, FIG. 1) of devising a structure of a liquid crystal panel such as to define the shape of the light blocking layer (an opening section) corresponding to the pixel electrode, a technology (see, e.g., JP-A-2009-69608, FIG. 2) of clipping the video signal higher than a set value when the average brightness value obtained from the video signal is equal to or lower than a threshold value under the determination that the reverse tilt domain is generated, and so on.

However, the technology of reducing the reverse tilt domain by the structure of the liquid crystal panel has disadvantages that the aperture rate is apt to be lowered, and that the technology is not applicable to the liquid crystal panels having already been manufactured without devising the structure. On the other hand, the technology of clipping the video signal equal to or higher than the set value has a disadvantage that the brightness of the image displayed is limited uniformly to the set value.

SUMMARY

An advantage of some aspects of the invention is to provide a technology for reducing the reverse tilt domain while solving the problems described above.

According to an aspect of the invention, there is provided a video processing circuit adapted to input a video signal adapted to designate applied voltages respectively to the liquid crystal elements pixel by pixel, and to define the applied voltages to the respective liquid crystal elements based on a corrected video signal, the video processing circuit including a boundary detection section adapted to detect a boundary between a first pixel having an applied voltage, which is designated by the video signal input and is lower than a first voltage, and a second pixel having an applied voltage, which is designated by the video signal input and is one of equal to and higher than a second voltage higher than the first voltage, in a present frame and in a previous frame, which is one frame earlier than the present frame, respectively, and a correction section adapted to correct the video signal adapted to designate the applied voltages to the liquid crystal elements corresponding to the first pixel and the second pixel abutting on a moving section in the boundary of the present frame moving one pixel from the boundary in the previous frame so as to reduce a lateral electrical field caused by the first pixel and the second pixel.

According to this aspect of the invention, since only the lateral electrical field between the pixels located on the both sides of the portion of the boundary of the present frame moving one pixel from the boundary of the previous frame is reduced, it becomes possible to prevent the reverse tilt domain from occurring while reducing the part (the display departure) where the image different from the image defined by the video signal is displayed.

Further, according to this aspect of the invention, since there is no need to make a change to the structure of the liquid crystal panel, degradation in aperture ratio is never caused, and it is also possible to apply the invention to the liquid crystal panels having already manufactured without devising the structure.

In this aspect of the invention, it is also possible that the correction section corrects the video signal adapted to designate the applied voltage to the liquid crystal element corresponding to each of a predetermined one or plural number of the first pixels placed consecutively from the first pixel abutting on the moving section in a direction toward a side opposite to the moving section so as to reduce the lateral electrical field.

Further, in this aspect of the invention, it is also possible that the correction section corrects the video signal adapted to designate the applied voltage to the liquid crystal element corresponding to each of a predetermined one or plural number of the second pixels placed consecutively from the second pixel abutting on the moving section in a direction toward a side opposite to the moving section so as to reduce the lateral electrical field.

By thus increasing the number of the corrected pixels, it becomes also possible to make the correction of the applied voltage inconspicuous.

Further, in this aspect of the invention, it is also possible that the correction section eliminates the first pixel and the second pixel located at positions on both sides of the moving section from a correction object if the first pixel and the second pixel abutting on the moving section are both the second pixels in the previous frame.

By performing the elimination described above, it becomes possible to further reduce the pixels constituting the display departure.

It should be noted that the invention can be recognized not only as the video processing circuit, but can also be recognized as a liquid crystal display device, an electronic apparatus including the liquid crystal display device, and a video processing method.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
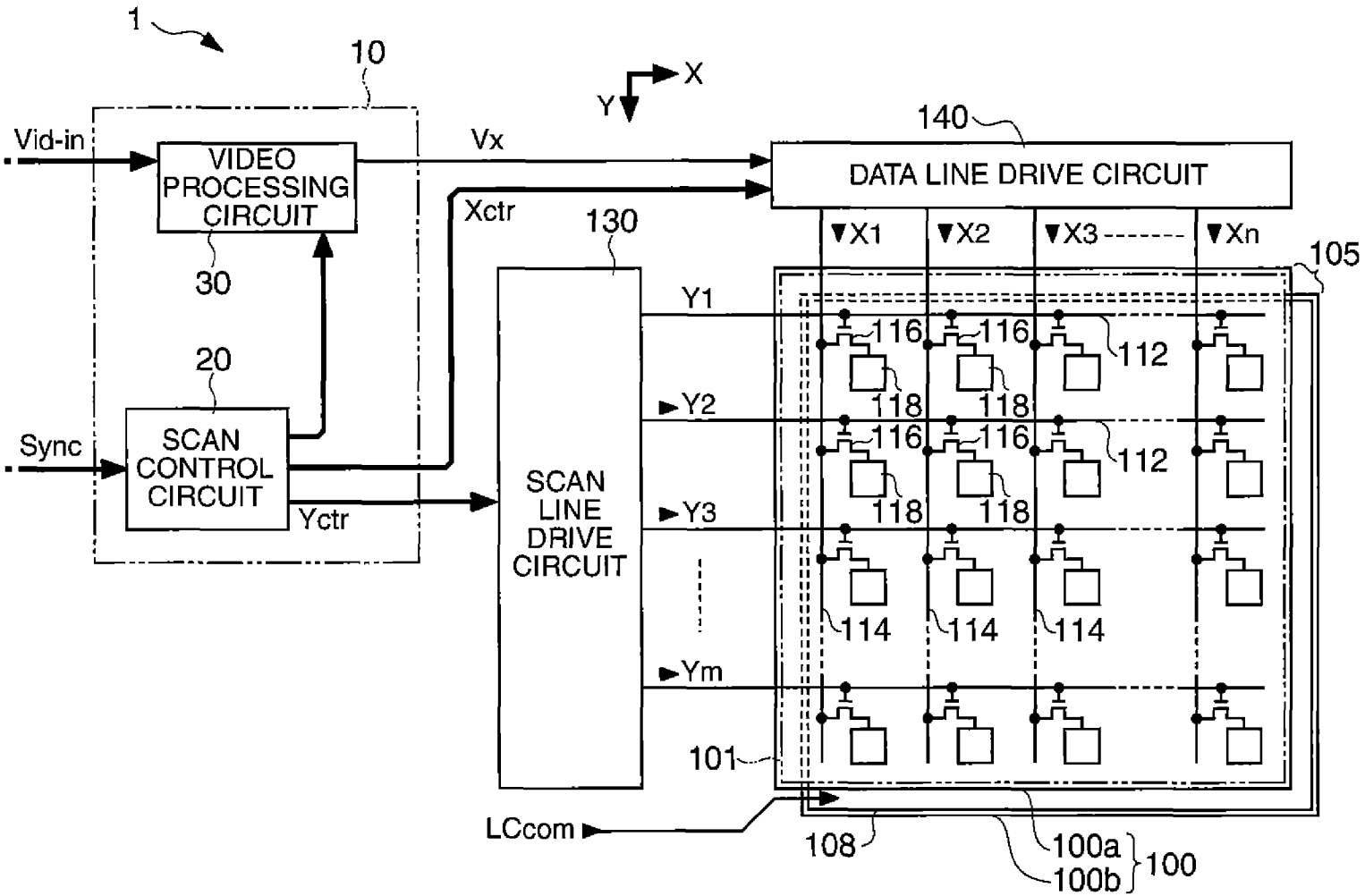
FIG. 1 is a diagram showing a liquid crystal display device to which a video processing circuit according to an embodiment of the invention is applied.

An embodiment of the invention will hereinafter be explained with reference to the drawings. FIG. 1 is a block diagram showing an overall configuration of a liquid crystal display device to which a video processing circuit according to an embodiment of the invention is applied. As shown in this drawing, the liquid crystal display device 1 has a control circuit 10, a liquid crystal panel 100, a scan line drive circuit 130, and a data line drive circuit 140.

Among these constituents, the control circuit 10 is supplied with a video signal Vid-in from a higher-level device in sync with a sync signal Sync. The video signal Vid-in is digital data for respectively designating the grayscale levels of the pixels in the liquid crystal panel 100, and is supplied in the order of the scan with a vertical scan signal, a horizontal scan signal, and a dot clock signal (all not shown) included in the sync signal Sync. It should be noted that although the video signal Vid-in designates the grayscale levels of the respective pixels, there is no objection to saying that the video signal Vid-in is for designating the applied voltages to the liquid crystal elements since the applied voltages to the liquid crystal elements are determined in accordance with the grayscale levels as described later.

The control circuit 10 is composed of a scan control circuit 20 and a video processing circuit 30. Among these circuits, the scan control circuit 20 generates various types of control signals to thereby controls each section in sync with the sync signal Sync. The video processing circuit 30, details of which will be described later, is for processing the video signal Vid-in as a digital signal to thereby output a data signal Vx as an analog signal.

The liquid crystal panel 100 has a configuration in which an element substrate (a first substrate) 100*a* and an opposed substrate (a second substrate) 100*b* are bonded to each other keeping a constant gap, and a liquid crystal 105 to be driven by an electrical field in a vertical direction is sandwiched in the gap.

Among the surfaces of the element substrate 100*a*, an opposed surface to the opposed substrate 100*b* is provided with a plurality ("m" rows) of scan lines 112 disposed along an X (lateral) direction in the drawing and a plurality ("n" columns) of data lines 114 disposed along a Y (vertical) direction while keeping electrical isolation with each of the scan lines 112.

It should be noted that in the present embodiment in order for distinguishing the scan lines 112 from each other, the scan lines 112 are respectively referred to as 1st, 2nd, 3rd, . . . , (m−1)-th, and m-th scan lines in sequence from the top in the drawing in some cases. Similarly, in order for distinguishing the data lines 114 from each other, the data lines 114 are respectively referred to as 1st, 2nd, 3rd, . . . , (n−1)-th, and n-th scan lines in sequence from the left in the drawing in some cases.

The element substrate 100*a* is further provided with sets of an n-channel TFT 116 and a pixel electrode 118 having a rectangular shape and a light transmissive property corresponding respectively to intersections between the scan lines 112 and the data lines 114. The gate electrode of the TFT 116 is connected to the scan line 112, the source electrode is connected to the data line 114, and the drain electrode is connected to the pixel electrode 118.

Incidentally, among the surfaces of the opposed substrate 100*b*, the opposed surface to the element substrate 100*a* is provided with a common electrode 108 having a light transmissive property disposed on the entire surface. The common electrode 108 is provided with a voltage LCcom by a circuit not shown in the drawing.

It should be noted that in FIG. 1 the opposed surface of the element substrate 100*a* is the side facing to the opposed substrate 100*b*. Therefore, the scan lines 112, the data lines 114, the TFTs 116, and the pixel electrodes 118 should be illustrated with broken lines. However, in order for avoiding difficulty in understanding the structure, these elements are all illustrated with solid lines.

Figure 2:
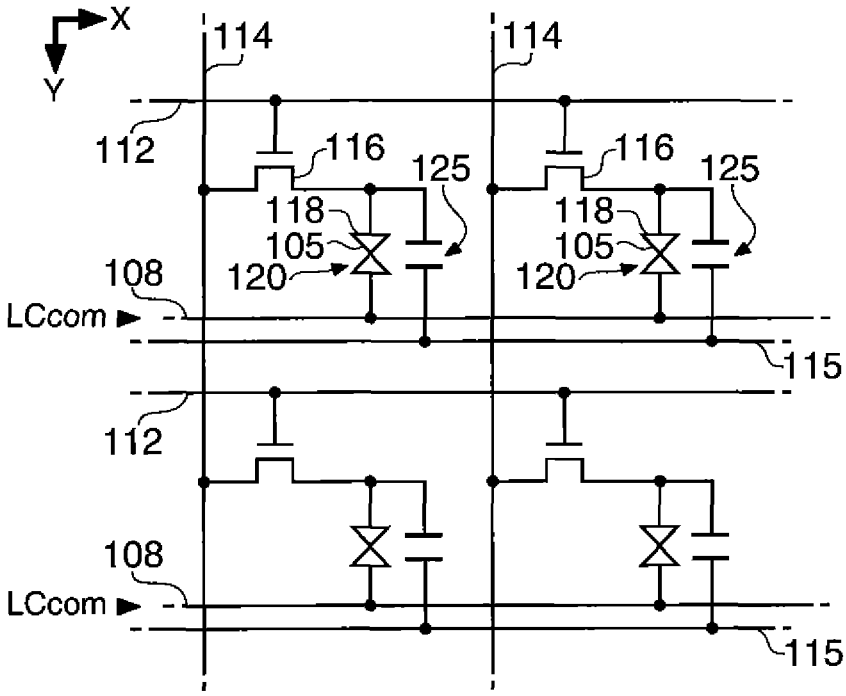
FIG. 2 is a diagram showing an equivalent circuit of a liquid crystal element in the liquid crystal display device.

FIG. 2 is a diagram showing an equivalent circuit of the liquid crystal panel 100. The liquid crystal panel 100 has a configuration in which the liquid crystal elements 120 each having the liquid crystal 105 sandwiched between the pixel electrode 118 and the common electrode 108 are arranged so as to correspond to the intersections between the scan lines 112 and the data lines 114.

Further, although omitted in FIG. 1, an auxiliary capacitor (a storage capacitor) 125 is provided in parallel to each of the liquid crystal elements 120 in practice as shown in FIG. 2. The auxiliary capacitor 125 has one end connected to the pixel electrode 118, and the other end commonly connected to a capacitance line 115. The capacitance line 115 is kept at a voltage constant with time.

In such a configuration, when the scan line 112 becomes in an H level, the TFT 116 having the gate electrode connected to that scan line becomes in an ON state to thereby connect the pixel electrode 118 to the data line 114. Therefore, by supplying the data line 114 with the data signal having a voltage corresponding to the grayscale when the scan line 112 is in the H level, the data signal is applied to the pixel electrode 118 via the TFT 116 thus set to the ON state. When the scan line 112 becomes in an L level, the TFT 116 becomes in an OFF state, and the voltage applied to the pixel electrode is held by a capacitive property of the liquid crystal element 120 and the auxiliary capacitor 125.

In the liquid crystal element 120, the molecular orientation state of the liquid crystal 105 varies in accordance with an electrical field generated between the pixel electrode 118 and the common electrode 108. Therefore, the liquid crystal element 120 becomes to have a transmittance corresponding to the applied and held voltage if the liquid crystal element 120 is of the transmissive type.

Since in the liquid crystal panel 100 the transmittance varies every liquid crystal element 120, the liquid crystal element 120 corresponds to the pixel. Further, the arrangement area of the pixels corresponds to a display area 101. It should be noted that in the present embodiment the VA type is adopted as the liquid crystal 105, and there is adopted a normally black mode in which the liquid crystal element 120 becomes in a black state when no voltage is applied.

Figure 5A:
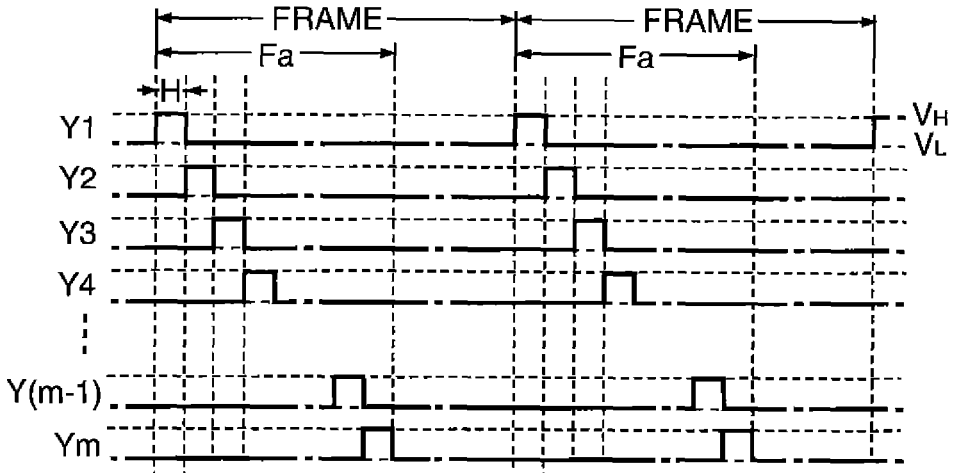
FIGS. 5A and 5B are diagrams showing a display operation in the liquid crystal display device.

The scan line drive circuit 130 supplies the 1st, 2nd, 3rd, . . . , and m-th scan lines 112 with scan signals Y1, Y2, Y3, . . . , and Ym, respectively, in accordance with a control signal Yctr by the scan control circuit 20. In detail, as shown in FIG. 5A, the scan line drive circuit 130 selects the scan lines 112 in the order of the 1st, 2nd, 3rd, . . . , (m−1)-th, and m-th rows throughout the frame, and at the same time, sets the scan signal to the scan line thus selected to the selection voltage $V_H$ (the H level) while setting the scan signals to other scan lines to the non-selection voltage $V_L$ (the L level).

It should be noted that the frame denotes a period in which the video signal Vid-in corresponding to one exposure is supplied, and if the frequency of the vertical scan signal included in the sync signal Sync is 60 Hz, the period of the frame is 16.7 ms, the inverse of the frequency. In the present embodiment, since the 1st, 2nd, 3rd, . . . , and m-th scan lines 112 are selected in sequence throughout the frame, the liquid crystal panel 100 is driven at the same rate as the video signal Vid-in. Therefore, in the present embodiment, the period necessary for making the liquid crystal panel 100 display the image corresponding to one exposure is equal to the frame.

The data line drive circuit 140 samples the data signal Vx supplied from the video processing circuit 30 to the 1st through n-th data lines 114 as data signals X1 through Xn in accordance with the control signal Xctr by the scan control circuit 20.

It should be noted that in the present explanation the voltages except the applied voltage to the liquid crystal element 120 take the ground potential not shown as the reference of the voltage of zero unless otherwise specified. This is because the applied voltage to the liquid crystal element 120 corresponds to an electrical potential difference between the voltage LCcom of the common electrode 108 and the pixel electrode 118, and therefore needs to be distinguished from other voltages. Further, in order for preventing the deterioration in the liquid crystal 105 due to the application of the direct current component, alternating-current drive is performed on the liquid crystal element 120. In detail, the applied voltage is applied to the pixel electrode 118 while being switched alternately between a positive voltage higher than the voltage Vcnt as the center of the amplitude and the negative voltage lower than the voltage Vcnt every frame. In such alternating-current drive, a plane reverse type for setting the writing polarities of all of the liquid crystal elements 120 in the same frame to be the same is adopted in the present embodiment.

Figure 4A:
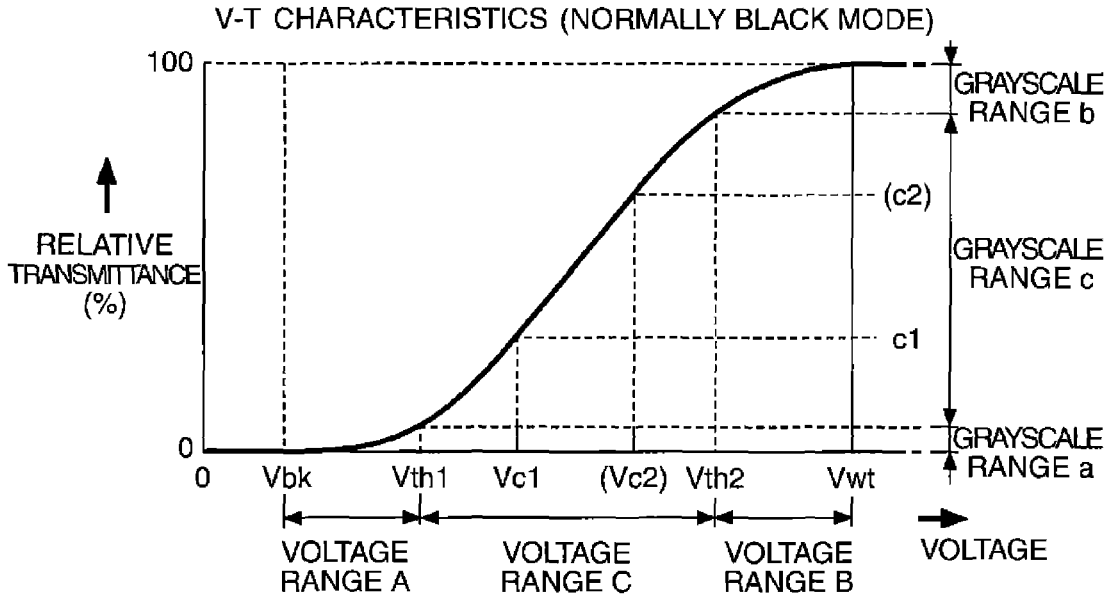
FIGS. 4A and 4B are diagrams showing display characteristics in the liquid crystal display device.

In the present embodiment, the relationship between the applied voltage (V) and the transmittance (T) of the liquid crystal element 120 can be expressed by the characteristics shown in FIG. 4A since the normally black mode of the VA type is adopted as the liquid crystal 105. In order for making the liquid crystal element 120 have the transmittance corresponding to the grayscale level designated by the video signal Vid-in, it should be sufficient to apply the voltage corresponding to the grayscale level to the liquid crystal element.

However, if the applied voltage to the liquid crystal element 120 is simply defined in accordance with the grayscale level designated by the video signal Vid-in, failure on display due to the reverse tilt domain occurs in some cases.

One of the causes of this failure is thought to be that the liquid crystal molecules held in the liquid crystal element 120 are disturbed due to the influence of the lateral electrical field when the liquid crystal molecules are in an unstable state, and as a result, the liquid crystal molecules become thereafter hard to take the orientational state corresponding to the applied voltage. If the applied voltage to the liquid crystal element 120 is in the voltage range A equal to or higher than the voltage Vbk of the black level in the normally black mode and lower than a threshold voltage Vth1 (a first voltage), the orientational state of the liquid crystal molecules can easily be disturbed because the restraining force by the vertical electrical field is in a level slightly stronger than the restraining force by the oriented film. This case corresponds to the period when the liquid crystal molecules are in the unstable state. The transmittance range (the grayscale range) of the liquid crystal element, to which the applied voltage in the voltage range A is applied, is assumed to be "a" for the sake of convenience.

Incidentally, the case of being affected by the lateral electrical field denotes the case in which the electrical potential difference between the pixel electrodes adjacent to each other increases. This is the case in which a dark pixel at the black level or close to the black level and a bright pixel at the white level or close to the white level are adjacent to each other in the image to be displayed.

Among these pixels, the dark pixel corresponds to the liquid crystal element 120 to which the applied voltage in the voltage range A is applied in the normally black mode shown in FIG. 4A, and what provides the lateral electrical field to the dark pixel is the bright pixel. In order for specifying the bright pixel, the bright pixel is defined as a liquid crystal element 120 having the applied voltage in a voltage range B equal to or higher than a threshold voltage Vth2 (a second voltage) and equal to or lower than a white level voltage Vwt in the normally black mode. The transmittance range (the grayscale range) of the liquid crystal element, to which the applied voltage in the voltage range B is applied, is assumed to be "b" for the sake of convenience.

It should be noted that in some cases it is conceivable that in the normally black mode, the threshold voltage Vth1 is an optical threshold voltage for setting the relative transmittance of the liquid crystal element to 10%, and the threshold voltage Vth2 is an optical saturation voltage for setting the relative transmittance of the liquid crystal element to 90%.

The liquid crystal element having the applied voltage in the voltage range A is in the state in which the reverse tilt domain easily occurs in response to the lateral electrical field when abutting on the liquid crystal element having the applied voltage in the voltage range B. By contraries, since the liquid crystal element in the voltage range B is dominantly affected by the vertical electrical field and is therefore in the stable state even when abutting on the liquid crystal element in the voltage range A, the reverse tilt domain hardly occurs unlike the liquid crystal element in the voltage range A.

Figure 6A:
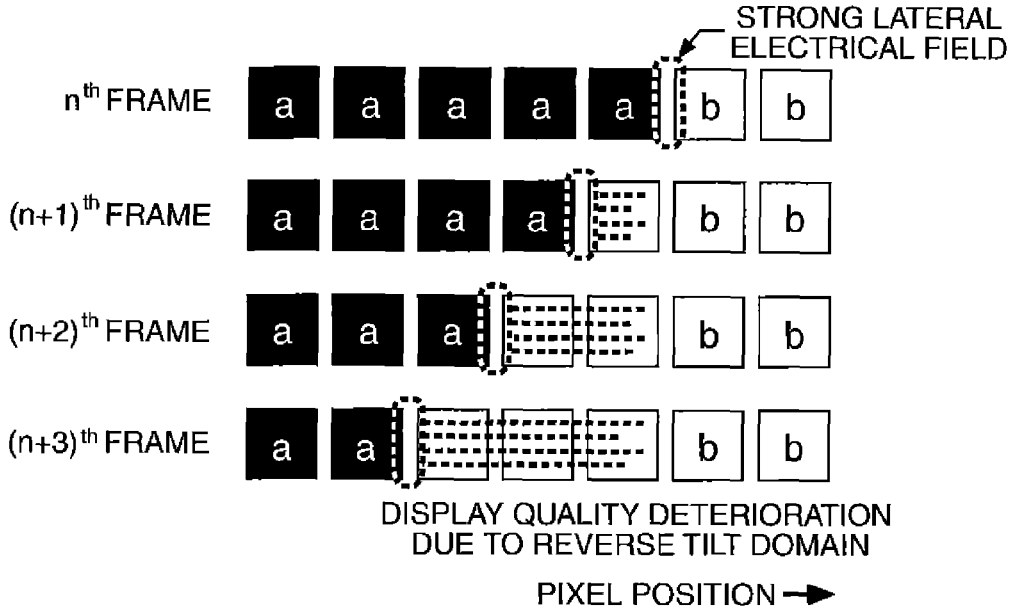
FIGS. 6A and 6B are diagrams showing an example of failure on display due to the influence of the lateral electrical field and an example of display of the present embodiment.

An example of the failure on display due to the reverse tilt domain will be explained. As shown in FIG. 6A, for example, the failure appears as a kind of a trailing phenomenon that a pixel, which is located at the right edge portion (trailing edge portion of a movement) of a dark pattern having consecutive dark pixels in the grayscale range "a", and should change from a dark pixel to a bright pixel, does not change to the bright pixel due to occurrence of the reverse tilt domain when the dark pattern moves leftward by one pixel every frame on the background composed of the bright pixels in the grayscale range "b" in the image designated by the video signal Vid-in.

Here, in the case in which the liquid crystal panel 100 is driven at the same rate as the supply rate of the video signal Vid-in as in the present embodiment, such a trailing phenomenon does not become visible (or is hardly observed) when a region of the dark pattern moves by two or more pixels every frame on the background composed of the bright pixels. There reason therefor can be thought as follows. That is, although the reverse tilt domain might occur in the bright pixel when the dark pixel and the bright pixel become adjacent to each other in a certain frame, taking the motion of the image into consideration, it is conceivable that the pixels in which the reverse tilt domain occurs are located discretely, and therefore, are not visually conspicuous.

It should be noted that from a different viewpoint in FIG. 6A it can be said that when a bright pattern having consecutive bright pixels moves leftward by one pixel every frame on the background composed of the dark pixels, the pixel, which is located at the left edge portion (the leading edge of the movement) of the bright pattern, and should change from the dark pixel to the bright pixel, does not change to the bright pixel due to occurrence of the reverse tilt domain. Further, in the drawing, only the vicinity of the boundary of one line is extracted from the image for the sake of convenience of explanation.

Here, the requirements for the reverse tilt domain to occur will be organized.

It can be said that:

1. if the dark pixel in the grayscale range "a" and the bright pixel in the grayscale range "b" are adjacent to each other in the image represented by the video signal Vid-in of a certain frame, 2. if the boundary representing the part on which the dark pixel and the bright pixel border each other moves one pixel from the previous frame, 3. the reverse tilt domain easily occurs in the pixel (the dark pixel in the normally black mode) to be provided with the lower applied voltage out of the dark pixel and the bright pixel abutting on the boundary.

As described above, the primary cause of the occurrence of the reverse tilt domain is the lateral electrical field, and therefore, it is conceivable that the occurrence of the reverse tilt domain of the requirement 3 can be prevented by taking the measures for preventing the strong lateral electrical field from occurring on the boundary fulfilling the requirements 1 and 2.

From such a viewpoint as described above, in the present embodiment, the video processing circuit 30 is disposed in the supply channel of the video signal Vid-in on the upstream side of the liquid crystal panel 100, and performs the following process. That is, the video processing circuit 30 analyzes the image represented by the video signal Vid-in to detect the boundary on which the dark pixel in the grayscale range "a" and the bright pixel in the grayscale range "b" border each other, and extracts only the portion (the moving portion) of the boundary thus detected having moved one pixel from the boundary in the previous frame.

Further, the video processing circuit 30 performs the process of replacing the grayscale level of the pixel (the dark pixel in the normally black mode) to be provided with the lower applied voltage out of the dark pixel and the bright pixel both abutting on the boundary (an application boundary) thus extracted, which is in the grayscale range "a," with the grayscale level c1 belonging to another grayscale range "c" (the grayscale range between the grayscale range "a" and the grayscale range "b") different from the grayscale range "b."

Thus, since the voltage Vc1 corresponding to the grayscale level c1 is applied to the liquid crystal element 120 according to the dark pixel in the liquid crystal panel 100, it results that no strong lateral electrical field is generated in the application boundary.

Further, the video processing circuit 30 performs the process of replacing the grayscale level of the pixel (the bright pixel in the normally black mode) to be provided with the higher applied voltage out of the dark pixel and the bright pixel both abutting on the boundary (the application boundary) thus extracted, which is in the grayscale range "b," with the grayscale level c2 belonging to the grayscale range "c."

Thus, since the voltage Vc2 corresponding to the grayscale level c2 is applied to the liquid crystal element 120 according to the bright pixel in the liquid crystal panel 100, it results that no strong lateral electrical field is generated in the application boundary.

Hereinafter, the details of the video processing circuit 30 will be explained with reference to FIG. 3. As shown in this drawing, the video processing circuit 30 has a correction section 300, a boundary detection section 302, a storage section 306, an application boundary determination section 308, a delay circuit 312, and a D/A converter 316.

Among these constituents, the delay circuit 312 is for accumulating the video signal Vid-in supplied from the higher-level device, and then retrieving it after a predetermined time elapses to output it as a video signal Vid-d, and is mainly composed of a first-in first-out (FIFO) memory and a multi-stage latch circuit. It should be noted that the accumulation and the retrieval in the delay circuit 312 are controlled by the scan control circuit 20.

In the present embodiment, the boundary detection section 302 analyzes the image represented by the video signal Vid-in to detect the boundary on which a pixel in the grayscale range "a" and a pixel in the grayscale range "b" border each other, and then outputs boundary information representing the boundary.

It should be noted that the boundary here strictly denotes the portion where the pixel in the grayscale range "a" and the pixel in the grayscale range "b" border each other. Therefore, the portion where the pixel in the grayscale range "a" and the pixel in the grayscale range "c" border each other, or the portion where the pixel in the grayscale range "b" and the pixel in the grayscale range "c" border each other, for example, is not treated as the boundary. Further, since the video signal Vid-in (Vid-d) represents the image to be displayed, the frame of the image represented by the video signal Vid-in (Vid-d) is also referred to as a present frame in some cases.

Incidentally, the storage section 306 is for storing the information of the boundary output by the boundary detection section 302, and then outputting the information of the boundary thus stored after one frame elapses. Therefore, it is arranged that the storage section 306 outputs the information of the boundary in the frame previous to the present frame, the information of the boundary of which is output from the boundary detection section 302. It should be noted that the storage and the output in the storage section 306 are controlled by the scan control circuit 20.

The application boundary determination section 308 is for determining the portion of the boundary of the present frame output from the boundary detection section 302 having moved one pixel upward, downward, leftward, or rightward from the boundary of the previous frame output from the storage section 306 as the application boundary, and then outputting the information of the application boundary thus determined.

It should be noted that since the application boundary denotes the boundary of the image represented by the video signal of the present frame and having moved one pixel from the boundary of the image represented by the video signal of the previous frame, the boundary not having moved from the previous frame or the boundary having moved two or more pixels are not treated as the application boundary.

The correction section 300 has a discrimination section 310 and a selector 314.

Among these sections, the discrimination section 310 discriminates whether or not each of the pixels represented by the video signal Vid-d delayed by the delay circuit 312 abuts on the application boundary determined by the application boundary determination section 308. Further, the determination section 310 determines whether or not the grayscale level of each of the pixels represented by the video signal Vid-d delayed by the delay circuit 312 belongs to the grayscale range "a," and whether or not the grayscale level of that pixel belongs to the grayscale range "b."

Further, if the pixel represented by the video signal Vid-d delayed by the delay circuit 312 abuts on the application boundary, and the grayscale level of that pixel belongs to the grayscale range "a," the discrimination section 310 sets the value of the data Q to be supplied to the selector 314 to, for example, "1." Further, if the pixel represented by the video signal Vid-d delayed by the delay circuit 312 abuts on the application boundary, and the grayscale level of that pixel belongs to the grayscale range "b," the discrimination section 310 sets the value of the data Q to, for example, "2."

It should be noted that if the pixel represented by the video signal Vid-d delayed by the delay circuit 312 does not abut on the application boundary, the discrimination section 310 sets the value of the data Q to "0." Further, if the pixel represented by the video signal Vid-d delayed by the delay circuit 312 belongs to neither the grayscale range "a" nor the grayscale range "b" although abutting on the application boundary, the discrimination section 310 sets the value of the data Q to "0."

It should be noted that since the boundary detection section 302 cannot detect the boundary throughout the image to be displayed unless the video signal of the pixels corresponding to at least a plurality of rows has been stored, the delay circuit 312 is provided for the purpose of adjusting the supply timing of the video signal Vid-in. Therefore, since the timing of the video signal Vid-in supplied from the higher-level device and the timing of the video signal Vid-d supplied from the delay circuit 312 are different from each other, the horizontal scanning period or the like is not identical between the both signals in a strict sense. However, the explanation will hereinafter be presented with no particular discrimination.

The selector 314 is for selecting either one of the input terminals "a," "b," and "c" in accordance with the value of the data Q supplied to the control terminal Set, and outputting the signal, which is supplied to the input terminal thus selected, from the output terminal Out as the video signal Vid-out. In detail, the selector 314 is supplied with the video signal Vid-d by the delay circuit 312 at the input terminal "a," and the video signal with the grayscale level c1 at the input terminal "b" as a replacement. Further, the video signal with the grayscale level c2 is also supplied at the input terminal "c" as a replacement.

Then, if the value of the data Q supplied to the control terminal Sel is "1," the selector 314 selects the input terminal "b," and then outputs the video signal with the grayscale level c1, which is supplied to the input terminal "b," as the video signal Vid-out. Further, if the value of the data Q is "0," the selector 314 directly outputs the video signal Vid-d, which is supplied to the input terminal "a," as the video signal Vid-out. Further, if the value of the data Q is "2," the selector 314 selects the input terminal "c," and then outputs the video signal with the grayscale level c2, which is supplied to the input terminal "c," as the video signal Vid-out.

In other words, the selector 314 functions as a correction section for correcting the video signal input thereto, and then outputting the video signal thus corrected.

The D/A converter 316 converts the video signal Vid-out as a digital data into a data signal Vx as an analog signal. As described above, the present embodiment adopts the plane reverse type, and therefore has a configuration of switching the polarity of the data signal Vx every frame.

It should be noted that the voltage LCcom to be applied to the common electrode 108, which can be thought to be substantially the same voltage as the voltage Vcnt, might be adjusted to be lower than the voltage Vcnt taking an off-leak current of the n-channel TFT 116 and so on into consideration.

In such a configuration, if the value of the data Q is "1," it means that the pixel represented by the video signal Vid-in abuts on the application boundary and the grayscale level of the pixel is included in the grayscale range "a." If the value of the data Q is "1," since the selector 314 selects the input terminal "b," the video signal Vid-d designating the grayscale level in the grayscale range "a" is replaced with the video signal designating the grayscale level c1, and is then output as the video signal Vid-out.

Further, in the present configuration, if the value of the data Q is "2," it means that the pixel represented by the video signal Vid-in abuts on the application boundary and the grayscale level of the pixel is included in the grayscale range "b." If the value of the data Q is "2," since the selector 314 selects the input terminal "c," the video signal Vid-d designating the grayscale level in the grayscale range "b" is replaced with the video signal designating the grayscale level c2, and is then output as the video signal Vid-out.

On the other hand, if the value of the data Q is "0," since the selector 314 selects the input terminal "a," the video signal Vid-d thus delayed is output as the video signal Vid-out.

In the explanation of the display operation of the liquid crystal display device 1, the video signal Vid-in is supplied from the higher-level device throughout the frame in the pixel order of (1st row, 1st column) through (1st row, n-th column), (2nd row, 1st column) through (2nd row, n-th column), (3rd row, 1st column) through (3rd row, n-th column), . . . , ($m^{th}$ row, 1st column) through ($m^{th}$ row, n-th column). The video processing circuit 30 performs, for example, the delay process and the replacement process on the video signal Vid-in, and then outputs the result as the video signal Vid-out.

Figure 5B:
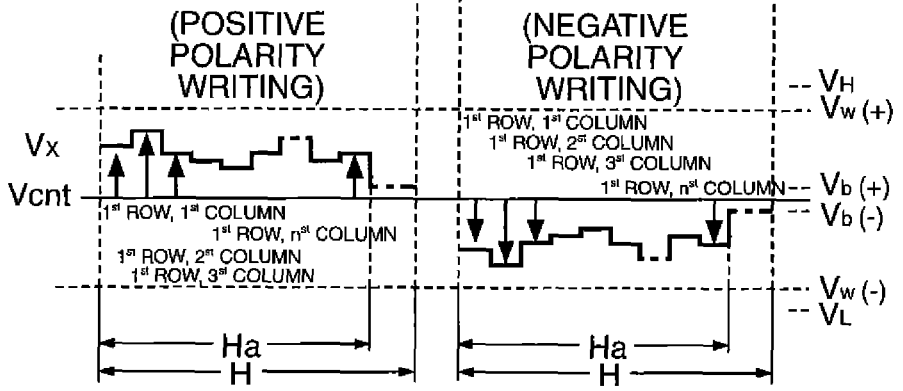

Here, when focusing attention on the horizontal effective scanning period (Ha) in which the video signal Vid-out of the (1st row, 1st column) through (1st row, n-th column) is output, the video signal Vid-out is converted by the D/A converter 316 into the data signal Vx having either one of positive and negative polarities (e.g., the positive polarity here) as shown in FIG. 5B. The data signal Vx is sampled by the data line drive circuit 140 on the data lines 114 corresponding to the 1st through n-th columns as the data signals X1 through Xn.

Incidentally, in the horizontal scanning period in which the video signal Vid-out corresponding to the (1st row, 1st column) through (1st row, n-th column) is output, the scan control circuit 20 controls the scan line drive circuit 130 to set only the scan signal Y1 to the H level. If the scan signal Y1 is in the H level, the TFTs 116 on the 1st row become in the ON state, and therefore, the data signals sampled on the data lines 114 are applied to the pixel electrodes 118 via the TFTs 116 in the ON state, respectively. Thus, the positive voltages corresponding to the grayscale levels designated by the video signal Vid-out are written into the liquid crystal elements of the (1st row, 1st column) through (1st row, n-th column), respectively.

Subsequently, the video signal Vid-in corresponding to the (2nd row, 1st column) through (2nd row, n-th column) is similarly processed by the video processing circuit 30 and then output as the video signal Vid-out, and at the same time, converted by the D/A converter 316 into the positive data signal to be sampled by the data line drive circuit 140 on the data lines 114 corresponding respectively to the 1st through n-th columns.

In the horizontal scanning period in which the video signal Vid-out corresponding to the (2nd row, 1st column) through (2nd row, n-th column) is output, since the scan line drive circuit 130 sets only the scan signal Y2 to the H level, the data signals sampled on the data lines 114 are applied to the pixel electrodes 118 via the TFTs 116 in the 2nd row in the ON state, respectively. Thus, the positive voltages corresponding to the grayscale levels designated by the video signal Vid-out are written into the liquid crystal elements of the (2nd row, 1st column) through (2nd row, n-th column), respectively.

Subsequently, substantially the same writing operation is performed on each of the 3rd, $4^{th}$, . . . , and m-th rows, and thus the voltages corresponding to the respective grayscale levels designated by the video signal Vid-out are written into the respective liquid crystal elements. Thus, it results that the transmissive image defined by the video signal Vid-in is formed.

In the subsequent frame, substantially the same writing operation is performed except the fact that the video signal Vid-out is converted into the negative data signal due to the polarity reversal of the data signal.

FIG. 5B is a voltage waveform chart showing an example of the data signal Vx in the case in which the video signal Vid-out corresponding to the (1st row, 1st column) through (1st row, n-th column) is output through out the horizontal scanning period (H) from the video processing circuit 30. Since the normally black mode is adopted in the present embodiment, the data signal Vx takes a higher voltage value (indicated by ↑ in the drawing) with respect to the amplitude center voltage Vcnt as the grayscale level processed by the video processing circuit 30 becomes brighter in the case of the positive polarity, while the data signal Vx takes a lower voltage value (indicated by ↓ in the drawing) with respect to the amplitude center voltage Vcnt as the grayscale level becomes brighter in the case of the negative polarity.

In detail, the voltage of the data signal Vx becomes the voltage shifted from the reference voltage Vcnt as much as an amount corresponding to the grayscale in a range from the voltage Vw(+) corresponding to white to the voltage Vb(+) corresponding to black in the case of the positive polarity, or in a range from the voltage Vw(−) corresponding to white to the voltage Vb(−) corresponding to black in the case of the negative polarity.

The voltage Vw(+) and the voltage Vw(−) are in a symmetrical relationship with each other about the voltage Vcnt. The voltage Vb(+) and the voltage Vb(−) are also in a symmetrical relationship with each other about the voltage Vcnt.

It should be noted that FIG. 5B is for showing the voltage waveform of the data signal Vx, which is different from the voltage (the electrical potential difference between the pixel electrode 118 and the common electrode 108) to be applied to the liquid crystal element 120. Further, the vertical scale of the voltage of the data signal in FIG. 5B is expanded compared to the voltage waveforms of the scan signals in FIG. 5A.

Subsequently, a specific example of the process by the video processing circuit 30 will be explained. In the case in which a part of the image of the present frame represented by the video signal Vid-in is, for example, as shown in the left column of FIG. 7B, the boundary detected by the boundary detection section 302 becomes as illustrated with the broken lines in the right column shown in FIG. 7B. On the other hand, if the same part of the image in the previous frame is as shown in the left column of FIG. 7A, the boundary output from the storage section 306 is as illustrated with the broken lines in the right column of FIG. 7A.

Figure 7A:
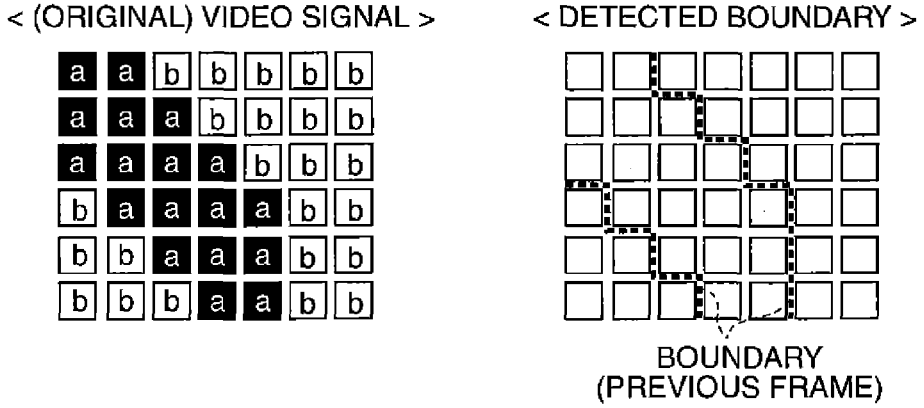
FIG. 7A to 7C are diagrams showing the contents of a correction process in the video processing circuit.
Figure 7B:
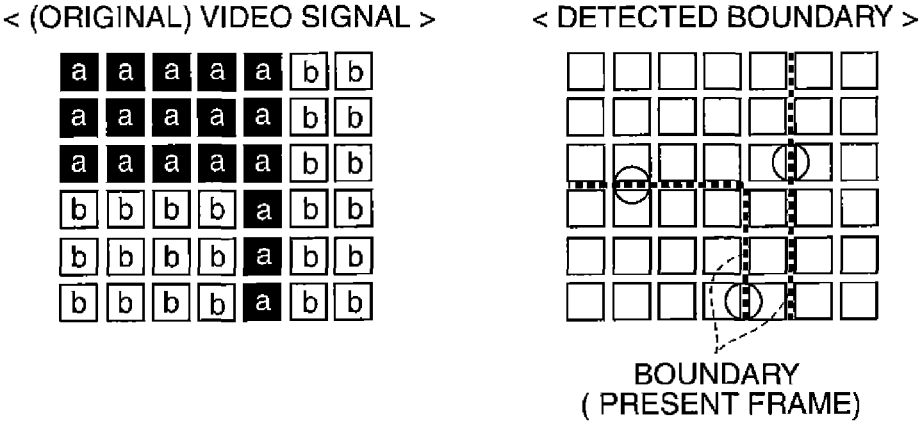

The application boundary determination section 308 outputs the portions (the portions surrounded by circles) of the boundary detected in the right column of FIG. 7B, which have moved one pixel from the boundary on the previous frame shown in FIG. 7A, as the application boundaries. In the present example, since the three portions constitute the respective application boundaries as shown in the right column of FIG. 7C, these application boundaries are referred to as application boundaries P, Q, and R in order for distinguishing them from each other.

Figure 3:
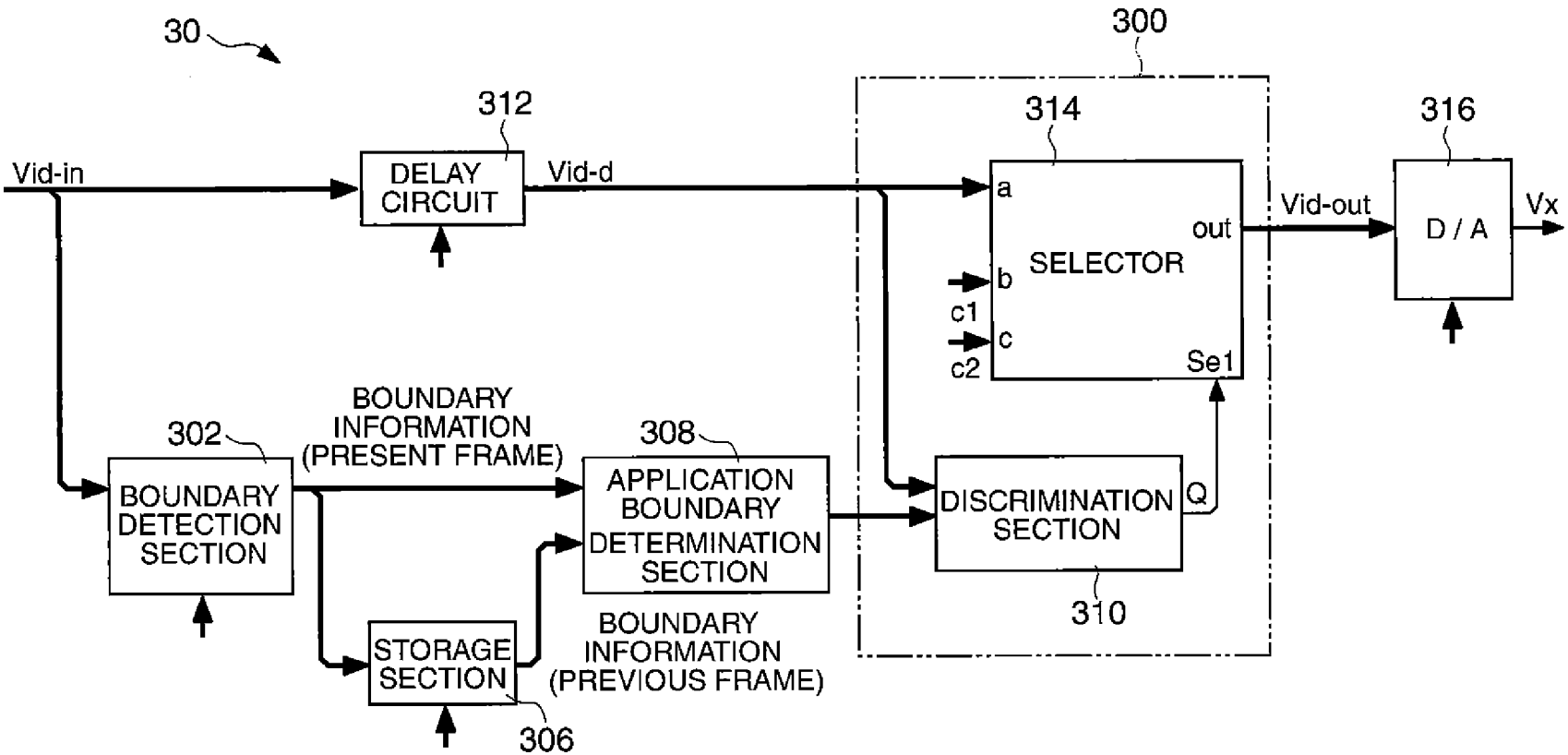
FIG. 3 is a diagram showing a configuration of the video processing circuit.

In the selector 314, since the dark pixel belonging to the grayscale range "a" out of the pixels abutting on the application boundary is replaced with the video signal with the grayscale level c1, the image shown in the left column of FIG. 7B is corrected into the image having the grayscale level distribution shown in the left column of the part 3 of FIG. 3. Specifically, the dark pixel located on the upper side of the application boundary P, the dark pixel located on the right side of the application boundary Q, and the dark pixel located on the left side of the application boundary R are each replaced with the pixel with the grayscale level c1.

Figure 7C:
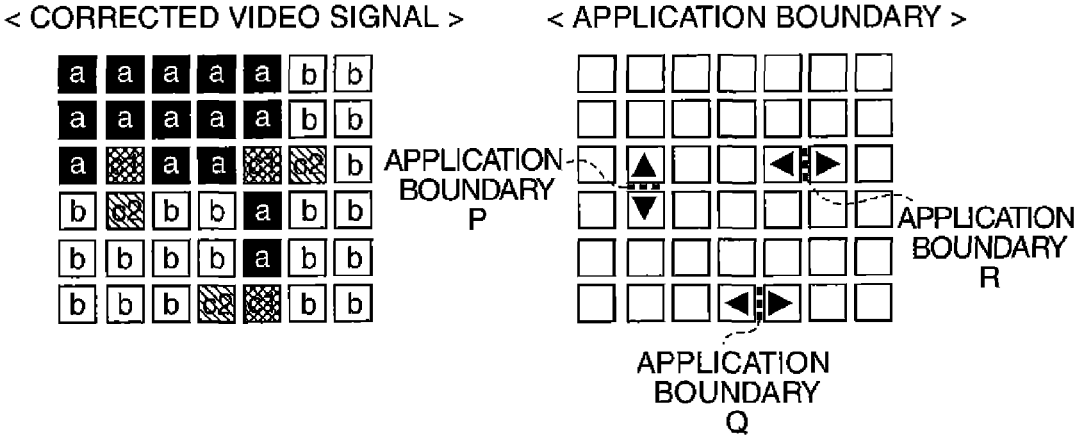

Further, in the selector 314, since the bright pixel belonging to the grayscale range "b" out of the pixels abutting on the application boundary is replaced with the video signal with the grayscale level c2, the image shown in the left column of FIG. 7B is corrected into the image having the grayscale level distribution shown in the left column of FIG. 7C. Specifically, the bright pixel located on the lower side of the application boundary P, the bright pixel located on the left side of the application boundary Q, and the bright pixel located on the right side of the application boundary R are each replaced with the pixel with the grayscale level c2.

Figure 8A:
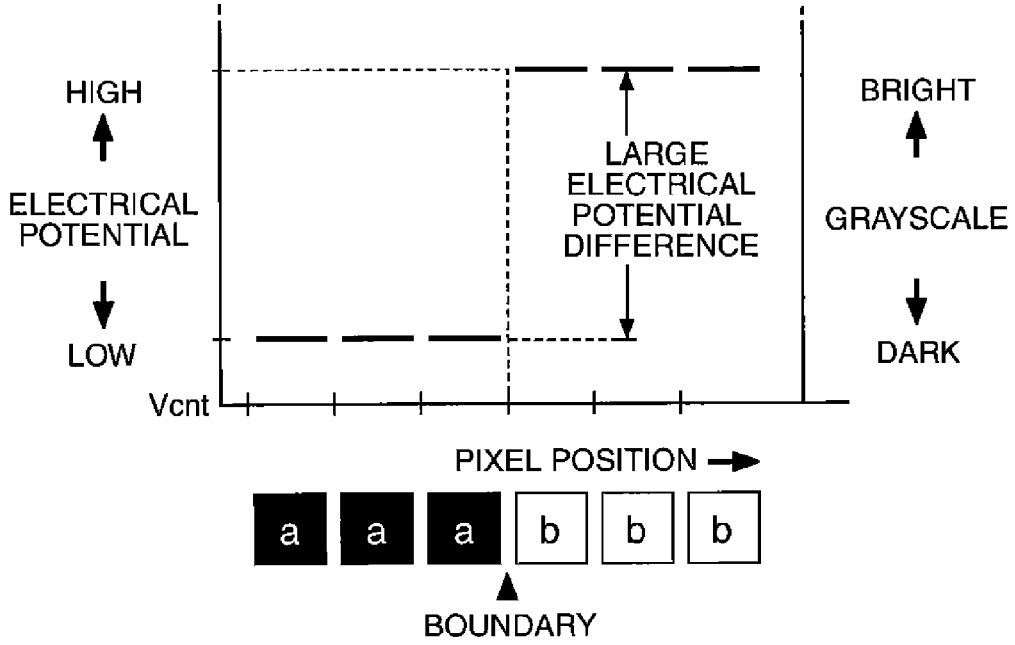
FIGS. 8A and 8B are diagrams showing reduction of the lateral electrical field by the correction process.

Assuming that the configuration of supplying the video signal Vid-in to the liquid crystal panel 100 without performing the process thereon by the video processing circuit 30 is adopted, the electrical potentials of the pixel electrodes in the dark pixel belonging to the grayscale range "a" and the bright pixel belonging to the grayscale range "b" become as shown in FIG. 8A in the case of the positive polarity writing. Although the electrical potential of the pixel electrode of the dark pixel becomes lower than the electrical potential of the pixel electrode of the bright pixel in the positive polarity writing, due to the large electrical potential difference, the influence of the lateral electrical field becomes apt to be exerted. It should be noted that although the high-low relationship between the electrical potentials is reversed in the case of the negative polarity, since there is no difference in that the electrical potential difference is large, the influence of the lateral electrical field also becomes apt to be exerted.

In contrast thereto, in the present embodiment, the application boundary is determined in the boundary on which the dark pixel belonging to the grayscale range "a" and the bright pixel belonging to the grayscale range "b" border each other, and then the video signal Vid-out corresponding to the dark pixel abutting on the application boundary is replaced with the grayscale level c1. Further, in the present embodiment, the video signal Vid-out corresponding to the bright pixel abutting on the application boundary is replaced with the grayscale level c2.

Figure 8B:
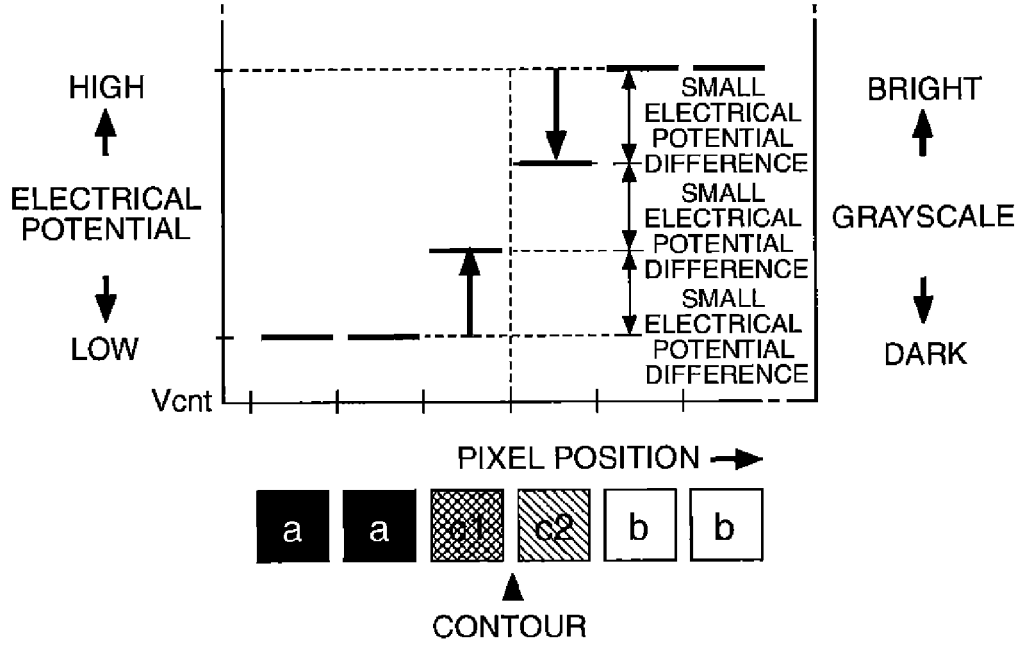

Therefore, the video signal Vid-out is raised so that the applied voltage to the liquid crystal element of the dark pixel rises, in other words, as shown in FIG. 8B if the electrical potential of the pixel electrode of the dark pixel is written positively. Further, the video signal Vid-out is dropped so that the applied voltage to the liquid crystal element of the bright pixel falls, in other words, as shown in FIG. 8B if the electrical potential of the pixel electrode of the bright pixel is written positively.

Figure 6B:
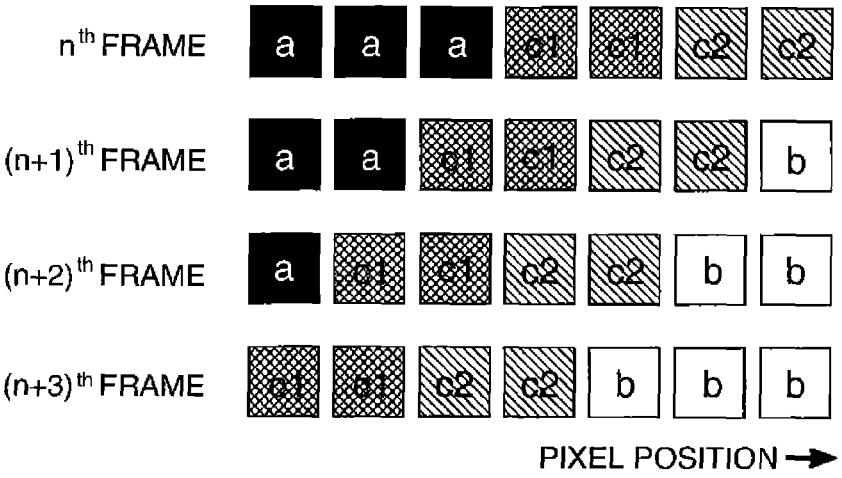

Therefore, even in the case in which the image represented by the video signal Vid-in moves so that the portion to be changed from the black pixel to the white pixel moves by one pixel as shown in FIG. 6A, the direct change from the dark pixel to the bright pixel does not occur in the liquid crystal panel 100. Specifically, the dark pixel changes to the bright pixel after once passing through the grayscale level c1, and then the grayscale level c2 as shown in FIG. 6B.

Therefore, in the present embodiment, since the strength of the lateral electrical field varies gradually and the strong lateral electrical field can be prevented from being applied to the application boundary, it becomes possible to prevent the failure on display due to the reverse tilt domain from occurring.

Further, in the present embodiment, the application boundary in the image of the present frame represented by the video signal Vid-in is limited to the portion of the boundary, on which the dark pixel belonging to the grayscale range "a" and the bright pixel belonging to the grayscale range "b" border each other, moving one pixel from the boundary in the previous frame. Therefore, in the present embodiment, the number of the pixels (the display departure pixels) each having the grayscale level designated by the original video signal Vid-in, which is replaced with the different grayscale levels c1 or c2 can be reduced compared to the configuration of simply setting the pixel abutting on the boundary in the present frame to the correction (replacement) object.

As described above, according to the present embodiment, it becomes possible to prevent the failure on display due to the reverse tilt domain described above from occurring. Further, since the grayscale level of each of the pixels abutting on the application boundaries is locally replaced in the image defined by the video signal Vid-in, the possibility that the modification of the display image due to the replacement is sensed by the user is also small. In addition, in the present embodiment, since there is no need to make a change to the structure of the liquid crystal panel 100, degradation in the aperture ratio is never caused, and therefore it is also possible to apply the invention to the liquid crystal panels having already manufactured without devising the structure.

Application/Modification Examples of Embodiment

In the embodiment described above, various applications and modifications are possible. The examples of the applications and the modifications will hereinafter be explained.

Case 1: Number of Pixels to be Replaced

In the embodiment described above, there is adopted the configuration of replacing the grayscale level of one dark pixel abutting on the application boundary with the grayscale level c1. In such a configuration, from the viewpoint that the lateral electrical field caused in the application boundary between the dark pixel and the bright pixel is reduced, it is preferable to increase the amount of raise in the applied voltage to the dark pixel abutting on the application boundary. It should be noted that to increase the amount of raise (correction amount) of the applied voltage means to deviate from the original image accordingly to cause the display departure.

Therefore, it is also possible to adopt the configuration in which if the dark pixels are located consecutively, the grayscale level of each of the K (K is an integer equal to or larger than 1) dark pixels consecutively placed from the dark pixel abutting on the application boundary in the direction (the direction perpendicular to the application boundary) of getting away from the application boundary is also replaced in addition to the dark pixel abutting on the application boundary, and at the same time regarding the bright pixel abutting on the application boundary the grayscale level of only the bright pixel abutting on the application boundary is replaced with the grayscale level c2.

In order for achieving this configuration, it is sufficient for the discrimination section 310 to output the value of "1" of the data Q in the following case. Specifically, it is sufficient that the value of "1" of the data Q is output in the case in which the grayscale level of the pixel placed in the direction of getting away from the application boundary and represented by the video signal Vid-d belongs to the grayscale range "a," the pixels with the grayscale levels belonging to the grayscale range "a" are consecutively placed from the application boundary to that pixel, and the distance from the application boundary to that pixel is equal to or smaller than (K+1) pixels. It should be noted that the number of pixels to be the replacement candidate is preferably in a range of about 2 through 10 including the pixel abutting on the application boundary.

Figure 9A:
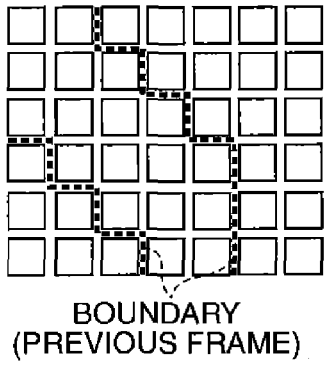
FIG. 9A to 9C are diagrams showing the contents of another correction process in the embodiment.
Figure 9B:
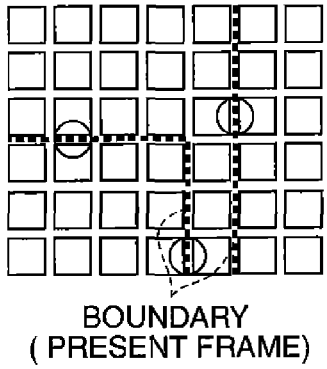
Figure 9C:
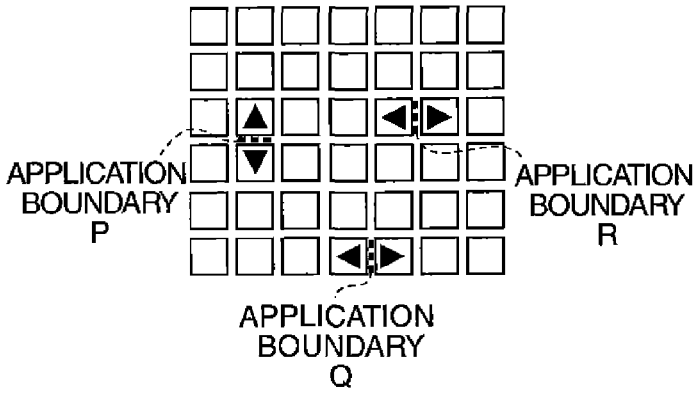

FIG. 9A to 9C are diagrams showing an example of the process in the case of replacing the grayscale level with respect to totally 2 pixels of the dark pixel abutting on the application boundary and one dark pixel adjacent to that dark pixel. Although the images of the previous frame and the present frame, and the detected boundary and the application boundary, are substantially the same as in the example shown in FIG. 7A to 7C, the grayscale of each of the dark pixels placed within 2 pixels in an upward direction from the application boundary P is replaced with the grayscale level c1 in the present example. In other words, the grayscale level of each of the totally 2 pixels including the dark pixel abutting on the application boundary P and the dark pixel adjacent to that dark pixel in the upward direction in addition thereto is replaced with the grayscale level c1. Similarly, the grayscale level of each of the totally 2 pixels including the dark pixel abutting on the application boundary R and the dark pixel adjacent to that dark pixel in the leftward direction in addition thereto is replaced with the grayscale level c1. It should be noted that since the dark pixel abutting on the application boundary Q has no dark pixel placed consecutively in the rightward direction, the grayscale level of the dark pixel abutting on the application boundary Q is replaced alone with the grayscale level c1.

By adopting the configuration of replacing the grayscale of one or more pixels consecutively placed from the pixel abutting on the application boundary in the direction of getting away from the application boundary in addition to the pixel abutting on the application boundary, it becomes possible to reduce the lateral electrical field without increasing the amount of the correction.

Figure 10A:
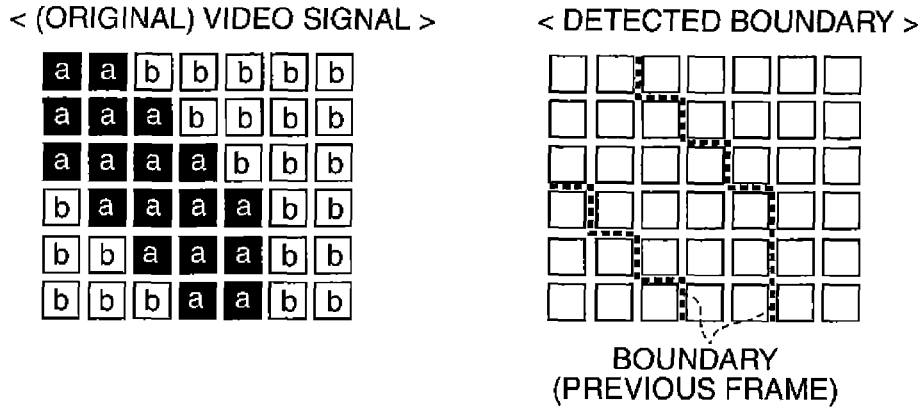
FIG. 10A to 10C are diagrams showing the contents of another correction process in the embodiment.
Figure 10B:
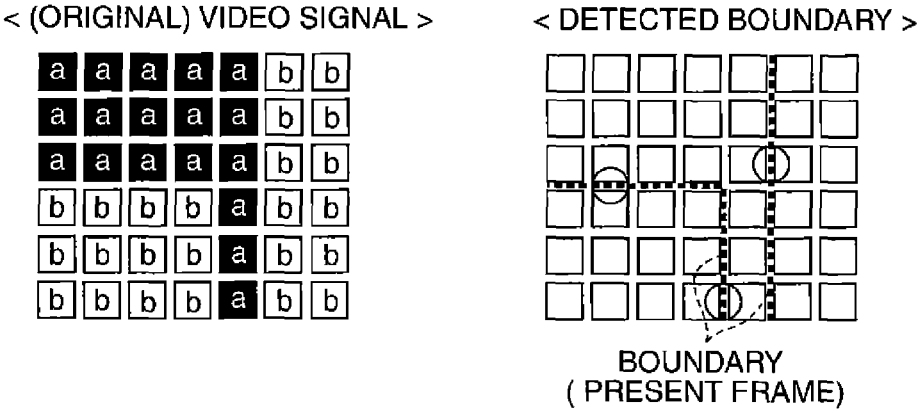
Figure 10C:
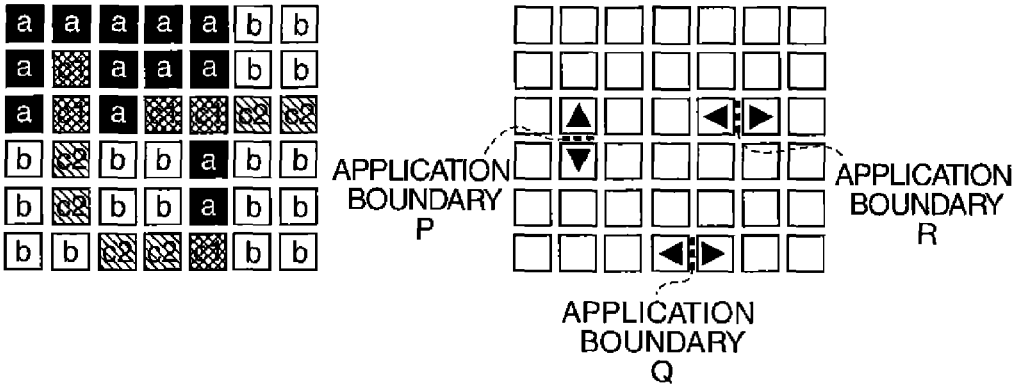

It should be noted that in the configuration of replacing the grayscale level with respect to the dark pixel abutting on the application boundary and the K dark pixels placed consecutively from that dark pixel in the direction of getting away from the application boundary, it is also possible to adopt the configuration of replacing the grayscale level with respect to the bright pixel abutting on the application boundary and also the K bright pixels placed consecutively from that bright pixel in the direction of getting away from the application boundary as shown in FIG. 10A to 10C.

In the case of this configuration, it is sufficient for the discrimination section 310 to output the value of "2" of the data Q in the case in which the grayscale level of the pixel represented by the video signal Vid-d belongs to the grayscale range "b," the pixels with the grayscale levels belonging to the grayscale range "b" are consecutively placed from the application boundary to that pixel, and the distance from the application boundary to that pixel is equal to or smaller than (K+1) pixels.

Further, in the configuration of replacing the grayscale level of each of the bright pixel abutting on the application boundary and the K bright pixels placed consecutively from the bright pixel in the direction of getting away from the application boundary, it is also possible to adopt the configuration of replacing the grayscale level of the dark pixel alone abutting on the application boundary with the grayscale level c1.

Case 2: Further Narrowing Down of Application Boundary

In the embodiment, the boundary on which the dark pixel in the grayscale range "a" and the bright pixel in the grayscale range "b" border each other is detected, and the portion of the boundary thus detected having moved one pixel from the boundary of the previous frame is defined as the application boundary. As such an application boundary, the following three patterns are possible considering the change from the previous frame to the present frame. Specifically, in the case in which the dark pixel and the bright pixel border each other in the present frame, there can be cited three cases, namely the case (pattern 1) in which the two pixels are both the dark pixels in the previous frame, the case (pattern 2) in which the two pixels are both the bright pixels in the previous frame, and the case (pattern 3) in which the two pixels are the bright pixel and the dark pixel, respectively, in the previous frame and are exchanged in the present frame.

As explained with reference to FIG. 6A, and inferable from the requirement 3 described above, the reverse tilt domain is apt to occur when the pixel (the pixel with the liquid crystal molecules in an unstable state), which has the lower applied voltage in the case in which the dark pixel and the bright pixel border each other in the previous flame, changes to the pixel with a higher applied voltage in the present frame.

Therefore, it is understood that there is only a little influence even if the pattern 2 is eliminated from the application boundary determined in the embodiment described above. This is because the pattern 2 corresponds to the case in which the two pixels are both the bright pixels having the liquid crystal molecules in the stable state, and either one of them is changed to the dark pixel due to the movement of the image pattern, and therefore, it can be said that both of the two pixels are in the condition hard for the reverse tilt domain to occur.

In the embodiment, although the application boundary determination section 308 is assumed to have the configuration of detecting the boundary on which the dark pixel and the bright pixel border each other in the present frame, and determining the portion of the boundary thus detected, which moves one pixel from the boundary in the previous frame, as the application boundary, by adopting the configuration in which the boundary is not determined as the application boundary if the dark pixel and the bright pixel bordering each other on that boundary are both the bright pixels in the previous frame, it results that the pixel of the pattern 2 is eliminated from the correction object.

Figure 11A:
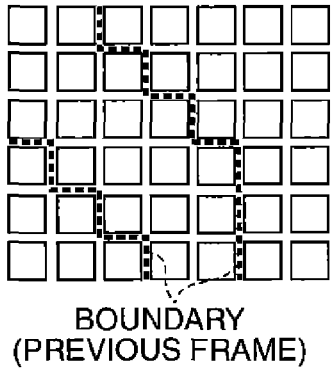
FIG. 11A to 11C are diagrams showing the contents of another correction process in the embodiment.
Figure 11B:
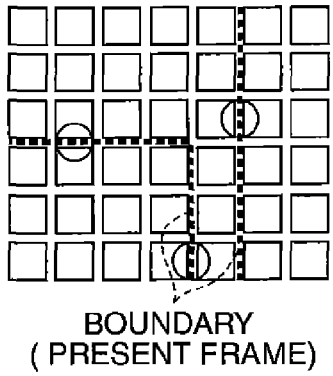
Figure 11C:
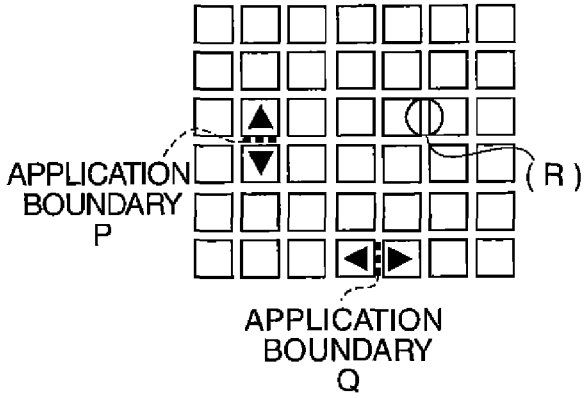

FIG. 11A to 11C are diagrams showing an example of the process of the case of eliminating the pattern 2 described above from the application boundary. The images of the previous frame and the present frame, and the boundaries detected are substantially the same as the example shown in FIG. 7A to 7C.

Although in the example shown in FIG. 7A to 7C the boundaries P, Q, and R are all determined as the application boundaries, among these boundaries the boundary R is eliminated from the correction object in the present example since the two pixels located on both sides of the boundary R are both the bright pixels in the previous frame.

By eliminating the pattern 2 as described above, it becomes possible to further reduce the pixels constituting the display departure. It should be noted that from a different viewpoint, the pattern 2 can also be rephrased as "the case in which the pattern composed of the bright pixels (the pixels with the higher voltage) moves toward the pattern composed of the dark pixels (the pixels with the lower voltage)."

Case 3: Normally White Mode

Although in the present embodiment the explanation is presented assuming that the normally black mode with the liquid crystal 105 of the VA type is adopted, it is also possible to adopt the TN type as the liquid crystal 105, and the normally white mode in which the liquid crystal elements 120 become in the white state when no voltage is applied.

Figure 4B:
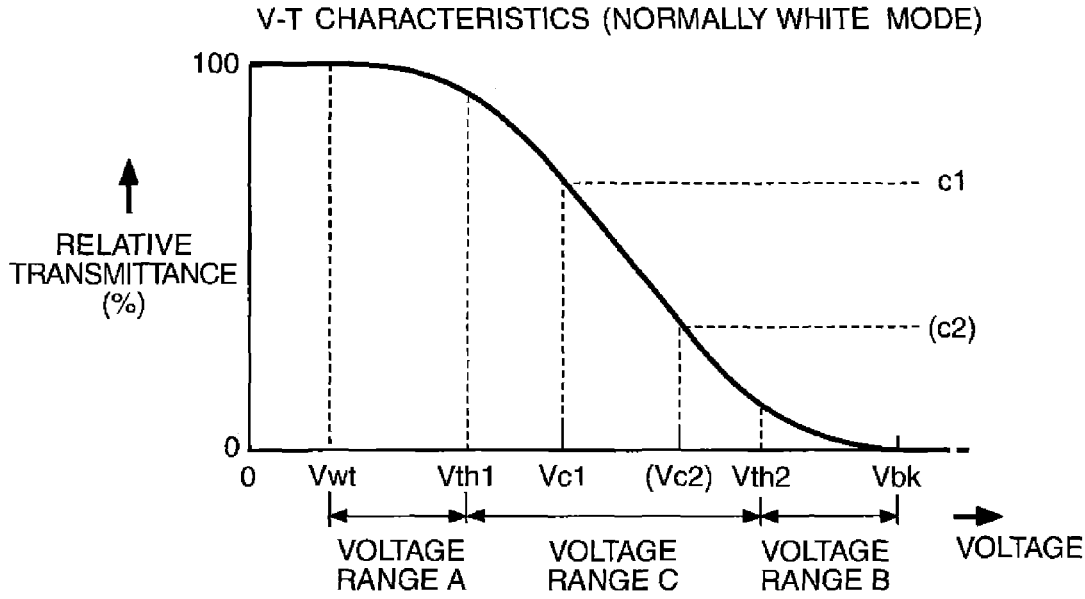

In the case of adopting the normally white mode, the relationship between the applied voltage and the transmittance of the liquid crystal element 120 can be expressed by the V-T characteristics shown in FIG. 4B, and the transmittance is reduced as the applied voltage rises. Although there is no difference in that the pixel with the lower applied voltage is easily affected by the lateral electrical field, the pixel with the lower applied voltage becomes the bright pixel in the normally white mode.

Therefore, in the normally white mode, the video processing circuit 30 determines the application boundary from the boundary on which the bright pixel having the applied voltage belonging to the voltage range "A" and the dark pixel having the applied voltage belonging to the voltage range "B" border each other. Further, the video processing circuit 30 performs the process of replacing the video signal Vid-out corresponding to the bright pixel abutting on the application boundary with the grayscale level c1 darker than the grayscale level corresponding to the voltage range "A" in the normally white mode.

Further, the video processing circuit 30 performs the process of replacing the video signal Vid-out corresponding to the dark pixel abutting on the application boundary with the grayscale level c2 brighter than the grayscale level corresponding to the voltage range "B" in the normally white mode. It should be noted that it is also possible to replace the grayscale level with respect to a plurality of pixels similarly to the case of the normally black mode.

In each of the embodiments described above, although it is assumed that the video signal Vid-in designates the grayscale levels of the pixels, it is also possible to assume that the video signal Vid-in directly designates the applied voltages to the liquid crystal elements. In the case in which the video signal Vid-in designates the applied voltages to the liquid crystal elements, it is sufficient to adopt the configuration of discriminating the boundary based on the applied voltage thus designated to thereby correct the voltage.

Electronic Apparatus

Figure 12:
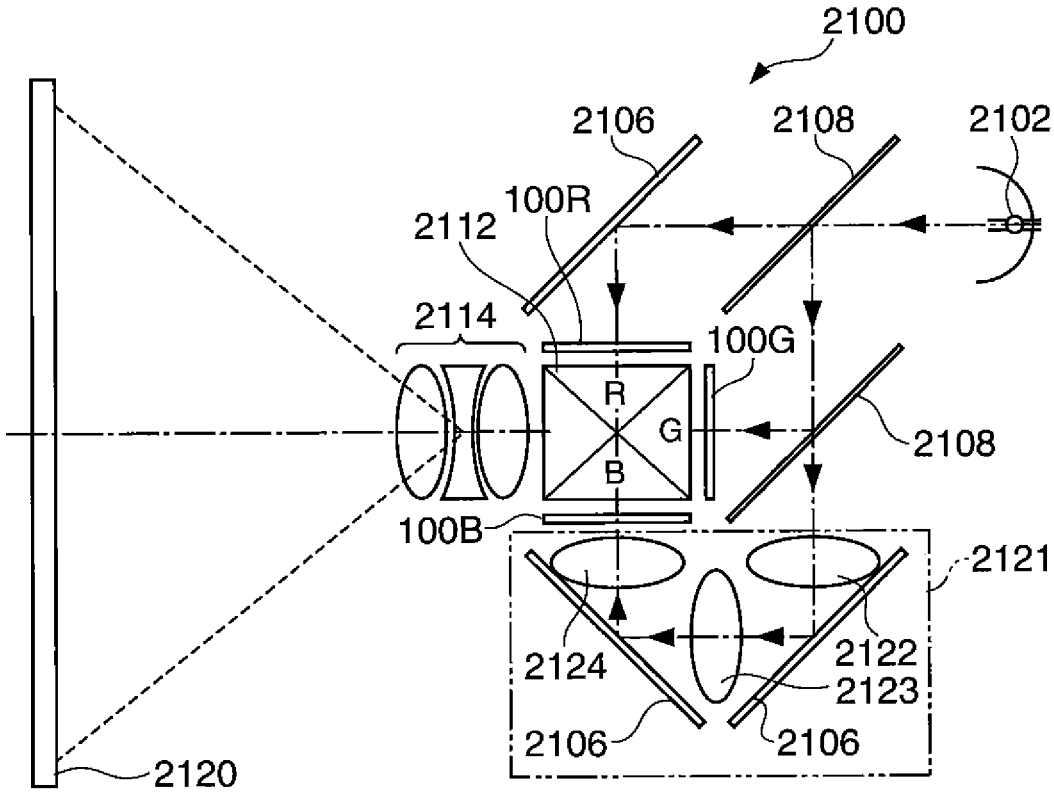
FIG. 12 is a diagram showing a projector to which the liquid crystal display device according to the embodiment is applied.

Then, as an example of the electronic apparatus using the liquid crystal display device according to the embodiment described above, a projection display device (a projector) using the liquid crystal panels 100 as the light valves will be explained. FIG. 12 is a plan view showing the configuration of the projector.

As shown in the drawing, a lamp unit 2102 composed mainly of a white light source such as a halogen lamp is disposed inside the projector 2100. A projection light beam emitted from the lamp unit 2102 is separated into three primary colors of R (red), G (green), and B (blue) by three mirrors 2106 and two dichroic mirrors 2108 disposed inside thereof, and then respectively guided to the light valves 100R, 100G, and 100B corresponding to the respective colors. It should be noted that since the B color light beam has a longer light path compared to the other colors, the R color and G color, and is therefore guided via a relay lens system 2121 composed of an entrance lens 2122, a relay lens 2123, and an exit lens 2124 in order for preventing the loss.

In the projector 2100, the three sets of liquid crystal display devices each including the liquid crystal panel 100 corresponding respectively to the R color, G color, and B color. The configuration of each of the light valves 100R, 100G, and 100B is substantially the same as that of the liquid crystal panel 100 described above. There is adopted the configuration in which the video signals for designating the grayscale levels of the respective primary color components of R color, G color, and B color are supplied from respective external higher-level circuits, and the light valves 100R, 100G, and 100B are driven respectively.

The light beams respectively modulated by the light valves 100R, 100G, and 100E enter the dichroic prism 2112 in three directions. Then, in the dichroic prism 2112, the light beams of the R color and B color are refracted 90 degrees while the light beam of the G color goes straight.

Therefore, it results that after the images of the respective primary colors are combined, the color image is projected by the projection lens 2114 to the screen 2120.

It should be noted that since the light beams corresponding respectively to the primary colors of the R color, G color, and B color enter the light valves 100R, 100G, and 100B due to the dichroic mirrors 2108, no color filter is required to be disposed. Further, since the transmission images of the light valves 100R, 100B are reflected by the dichroic prism 2112 and then projected while the transmission image of the light valve 100G is projected directly, there is adopted the configuration in which the horizontal scanning direction of the light valves 100R, 100E is set to the reverse direction of the horizontal scanning direction of the light valve 100G to thereby display the horizontally mirror reversed images.

As an example of applying the liquid crystal panel 100 to the light valve, there can be cited a television set of the rear projection type besides the projector explained above with reference to FIG. 12. Further, the liquid crystal panel 100 can also be applied to a mirror-less interchangeable lens camera, an electronic view finder (EVF) in a video camera, and so on.

Besides the above, as an applicable electronic apparatus, there can be cited a head mount display, a car navigation system, a pager, an electronic organizer, an electronic calculator, a word processor, a workstation, a picture phone, a POS terminal, a digital still camera, a cellular phone, an apparatus equipped with a touch panel, and so on. Further, it is obvious that the liquid crystal display device described above can be applied to the various types of electronic apparatuses cited above.

The entire disclosure of Japanese Patent Application No. 2010-039794, filed Feb. 25, 2010 is expressly incorporated by reference herein.

What is claimed is:

1. A video processing circuit adapted to input a video signal adapted to designate applied voltages respectively to the liquid crystal elements pixel by pixel, and to define the applied voltages to the respective liquid crystal elements based on a corrected video signal, the video processing circuit comprising:

a boundary detection section adapted to detect a boundary between a first pixel having an applied voltage, which is designated by the video signal input and is lower than a first voltage, and a second pixel having an applied voltage, which is designated by the video signal input and is one of equal to and higher than a second voltage higher than the first voltage, in a present frame and in a previous frame, which is one frame earlier than the present frame, respectively; and a correction section adapted to correct the video signal adapted to designate the applied voltages to the liquid crystal elements corresponding to the first pixel and the second pixel abutting on a moving section in the boundary of the present frame moving one pixel from the boundary in the previous frame so as to reduce a lateral electrical field caused by the first pixel and the second pixel, wherein the correction section corrects the video signal adapted to designate the applied voltage to the liquid crystal element corresponding to each of a predetermined one or plural number of pixels placed consecutively from the first pixel abutting on the moving section in a direction toward a side opposite to the moving section so as to reduce the lateral electrical field, and the correction section corrects the video signal adapted to designate the applied voltage to the liquid crystal element corresponding to each of a predetermined one or plural number of pixels placed consecutively from the second pixel abutting on the moving section in a direction toward a side opposite to the moving section so as to reduce the lateral electrical field.

2. The video processing circuit according to claim 1, wherein the correction section eliminates the first pixel and the second pixel located at positions on both sides of the moving section from a correction object if the first pixel and the second pixel abutting on the moving section are both the second pixels in the previous frame.

3. A video processing method adapted to correct a video signal adapted to designate applied voltages respectively to the liquid crystal elements pixel by pixel, and to define the applied voltages to the respective liquid crystal elements based on a corrected video signal, the video processing method comprising:

detecting a boundary between a first pixel having an applied voltage, which is designated by the video signal input and is lower than a first voltage, and a second pixel having an applied voltage, which is designated by the video signal input and is one of equal to and higher than a second voltage higher than the first voltage, in a present frame and in a previous frame, which is one frame earlier than the present frame, respectively;

correcting the video signal adapted to designate the applied voltages to the liquid crystal elements corresponding to the first pixel and the second pixel abutting on a moving section in the boundary of the present frame moving one pixel from the boundary in the previous frame so as to reduce a lateral electrical field caused by the first pixel and the second pixel, such that:

the video signal adapted to designate the applied voltage to the liquid crystal element corresponding to each of a predetermined one or plural number of pixels placed consecutively from the second pixel abutting on the moving section in a direction toward a side opposite to the moving section is corrected so as to reduce the lateral electrical field; and the video signal adapted to designate the applied voltage to the liquid crystal element corresponding to each of a predetermined one or plural number of pixels placed consecutively from the second pixel abutting on the moving section in a direction toward a side opposite to the moving section is corrected so as to reduce the lateral electrical field.

4. A liquid crystal display device comprising:

a liquid crystal panel having a plurality of liquid crystal elements composed of a plurality of pixel electrodes disposed on a first substrate corresponding respectively to a plurality of pixels, a common electrode disposed on a second substrate, and a liquid crystal sandwiched between the pixel electrodes and the common electrode; and a video processing circuit adapted to input a video signal adapted to designate applied voltages respectively to the liquid crystal elements pixel by pixel, and to define the applied voltages to the respective liquid crystal elements based on a corrected video signal, wherein the video processing circuit includes:

a boundary detection section adapted to detect a boundary between a first pixel having an applied voltage, which is designated by the video signal input and is lower than a first voltage, and a second pixel having an applied voltage, which is designated by the video signal input and is one of equal to and higher than a second voltage higher than the first voltage, in a present frame and in a previous frame, which is one frame earlier than the present frame, respectively, and a correction section adapted to correct the video signal adapted to designate the applied voltages to the liquid crystal elements corresponding to the first pixel and the second pixel abutting on a moving section in the boundary of the present frame moving one pixel from the boundary in the previous frame so as to reduce a lateral electrical field caused by the first pixel and the second pixel, such that:

the video signal adapted to designate the applied voltage to the liquid crystal element corresponding to each of a predetermined one or plural number of pixels placed consecutively from the second pixel abutting on the moving section in a direction toward a side opposite to the moving section is corrected so as to reduce the lateral electrical field: and the video signal adapted to designate the applied voltage to the liquid crystal element corresponding to each of a predetermined one or plural number of pixels placed consecutively from the second pixel abutting on the moving section in a direction toward a side opposite to the moving section is corrected so as to reduce the lateral electrical field.

5. An electronic apparatus comprising the liquid crystal display device according to claim 4.

* * * * *